US010743735B2

(12) United States Patent
Chudkosky

(10) Patent No.: US 10,743,735 B2
(45) Date of Patent: Aug. 18, 2020

(54) FLOOR CLEANING DEVICE

(71) Applicant: Diversey, Inc., Fort Mill, SC (US)

(72) Inventor: Frank Chudkosky, Anderson, SC (US)

(73) Assignee: Diversey, Inc., Fort Mill, SC (US)

( * ) Notice: Subject to any disclaimer, the term of this patent is extended or adjusted under 35 U.S.C. 154(b) by 46 days.

(21) Appl. No.: 16/067,851

(22) PCT Filed: Jan. 12, 2017

(86) PCT No.: PCT/US2017/013094
§ 371 (c)(1),
(2) Date: Jul. 3, 2018

(87) PCT Pub. No.: WO2017/123690
PCT Pub. Date: Jul. 20, 2017

(65) Prior Publication Data

US 2019/0008350 A1 Jan. 10, 2019

Related U.S. Application Data

(60) Provisional application No. 62/279,675, filed on Jan. 16, 2016.

(51) Int. Cl.
*A47L 11/29* (2006.01)
*A47L 11/40* (2006.01)
*A47L 11/30* (2006.01)

(52) U.S. Cl.
CPC ..... *A47L 11/305* (2013.01); *A47L 11/29* (2013.01); *A47L 11/4002* (2013.01);
(Continued)

(58) Field of Classification Search
CPC .. A47L 11/29; A47L 11/4002; A47L 11/4077; A47L 11/4083
See application file for complete search history.

(56) References Cited

U.S. PATENT DOCUMENTS 3,896,521 A * 7/1975 Parise ..... A47L 11/34 15/321
5,360,307 A 11/1994 Schemm et al.
(Continued)

FOREIGN PATENT DOCUMENTS

CN 201378902 Y 1/2010
CN 202920081 U 5/2013
(Continued)

*Primary Examiner* — Randall E Chin
(74) *Attorney, Agent, or Firm* — Fox Rothschild LLP

(57) ABSTRACT

A cleaning device comprises an upper cleaning solution tank comprising an outlet, a motorized chassis located beneath the solution tank and an electronics compartment defined at least partly by splash shields and a drip shield. The splash shields define a top and sides of the electronics compartment, and the drip shield defines a bottom side of the electronics compartment and includes at least one drip hole smaller than 2 mm in diameter. A wire opening in the splash shields includes a protective cover overlying the opening, the protective covering containing at least one passage facing in a direction opposite to the solution tank allowing a wire to pass through the passage, through the wire opening, and into the electronics compartment. Fluid lines extend from the outlet towards a bottom of the cleaning device and exterior to the electronics compartment. An enclosed electronics unit may also include wire openings and protective covers.

15 Claims, 8 Drawing Sheets

(52) U.S. Cl.
CPC ..... *A47L 11/4077* (2013.01); *A47L 11/4083* (2013.01); *A47L 11/4022* (2013.01); *A47L 2201/06* (2013.01)

(56) References Cited

U.S. PATENT DOCUMENTS

| | | | | |
|---|---|---|---|---|
| 6,124,694 | A | 9/2000 | Bancroft et al. | |
| 6,667,592 | B2 | 12/2003 | Jacobs et al. | |
| 8,438,695 | B2 | 5/2013 | Gilbert, Jr. et al. | |
| 8,532,860 | B2 | 9/2013 | Daly | |
| 9,028,617 | B2 | 5/2015 | Balas et al. | |
| 2003/0070252 | A1* | 4/2003 | Pedlar ..... | A47L 11/305 15/401 |

FOREIGN PATENT DOCUMENTS

| | | | |
|---|---|---|---|
| CN | 203301286 | U | 11/2013 |
| EP | 1595488 | A1 | 11/2005 |

* cited by examiner

FLOOR CLEANING DEVICE

CROSS-REFERENCE TO RELATED APPLICATIONS

The present application is the U.S. National Phase of International Application Serial Number PCT/US2017/013094, filed on Jan. 12, 2017, which claims priority to U.S. Provisional Patent Application Ser. No. 62/279,675, filed Jan. 16, 2016 the disclosures of which are incorporated herein by reference in their entireties.

BACKGROUND OF THE INVENTION

The present invention is in the technical field of floor cleaning devices. More particularly, the present invention is in the technical field of safety features for automated floor cleaners.

Conventional automated self-propelled cleaning robots offer many advantages over human-operated machines, such as lower ongoing operating costs and the ability to clean large floor surfaces with minimal human interaction. Examples of existing automation systems for self-propelled cleaning robots are disclosed in commonly assigned U.S. Pat. Nos. 9,028,617, 8,532,860, 6,667,592, and 6,124,694, the contents of which are expressly incorporated by reference herein.

Unfortunately, self-propelled cleaning robots may create a slightly elevated risk of damage to the robot or surrounding obstacles in the event the robot inadvertently collides or makes contact with surrounding obstacles. Further, damage to the robot or surrounding areas might also occur in the unlikely event that an unexpected fault occurs within the robot creating hazards such as fire, or risks of electrical shock. Therefore, it is desirable to improve or add safety measures to existing automated self-propelled cleaning robots.

SUMMARY OF THE INVENTION

In one embodiment of a cleaning device for cleaning floors, the device comprises a solution tank configured to store cleaning solution, wherein the solution tank is located at a top side of the cleaning device and comprises an outlet. The cleaning device may also include a motorized chassis located beneath the solution tank and comprising an electronics compartment, the electronics compartment defined at least partly by splash shields and a drip shield, the splash shields defining a top and sides of the electronics compartment, and the drip shield defining a bottom side of the electronics compartment. The splash shields may include at least one wire opening and a protective cover overlying the at least one wire opening. The protective covering may contain at least one passage facing in a direction opposite to the solution tank and adapted to allow a wire to pass through the passage and through the wire opening into the electronics compartment. Fluid lines may extend from the outlet towards a bottom of the cleaning device and exterior to the electronics compartment.

In another embodiment, an autonomous floor cleaning machine may comprise an enclosed electronics unit comprising at least one of electrical, sensor, and communications components and associated wiring entering into and exiting from the electronics unit through at least one first wire opening. The floor cleaning machine may further comprise a dry compartment comprising splash shields defining a top and sides of the dry compartment, the dry compartment further comprising at least one additional electrical component and associated wiring entering into and exiting from the dry compartment through at least one second wire opening in one of the splash shields. The floor cleaning machine may comprise a cleaning solution tank located at a top side of the cleaning machine and at least partially disposed above the electronics unit and the dry compartment. In one or more embodiments, a protective cover overlies the at least one first and second wire openings, the protective covering containing at least one passage facing downward in a direction opposite to the cleaning solution tank and sized to allow the associated wiring to pass through the passage and through the wire openings. The floor cleaning machine may further comprise a wet compartment disposed outside of the dry compartment and comprise fluid lines extending from the cleaning solution tank towards a bottom of the floor cleaning machine.

Also contemplated is a method of assembling a cleaning device for cleaning floors comprising providing a cleaning solution tank at a top side of the cleaning device, providing a motorized chassis located beneath the solution tank. The assembly method may also comprise building an electronics compartment to protect at least one electrical component on the motorized chassis by assembling splash shields defining a top and sides of the electronics compartment. In embodiments, the splash shields comprise at least one opening and a protective cover overlying the at least one wire opening, the protective covering containing at least one passage facing in a direction opposite to the solution tank. The electronics compartment is also built by further assembling a drip shield defining a bottom side of the electronics compartment. The assembly method may further comprise routing electrical wiring through the at least one passage and through the at least one wire opening and coupling the electrical wiring to the electrical component. The assembly method may further comprise coupling fluid lines to the cleaning solution tank and routing the fluid lines towards a bottom of the cleaning device and exterior to the electronics compartment.

DETAILED DESCRIPTION OF THE INVENTION

Figure 1:
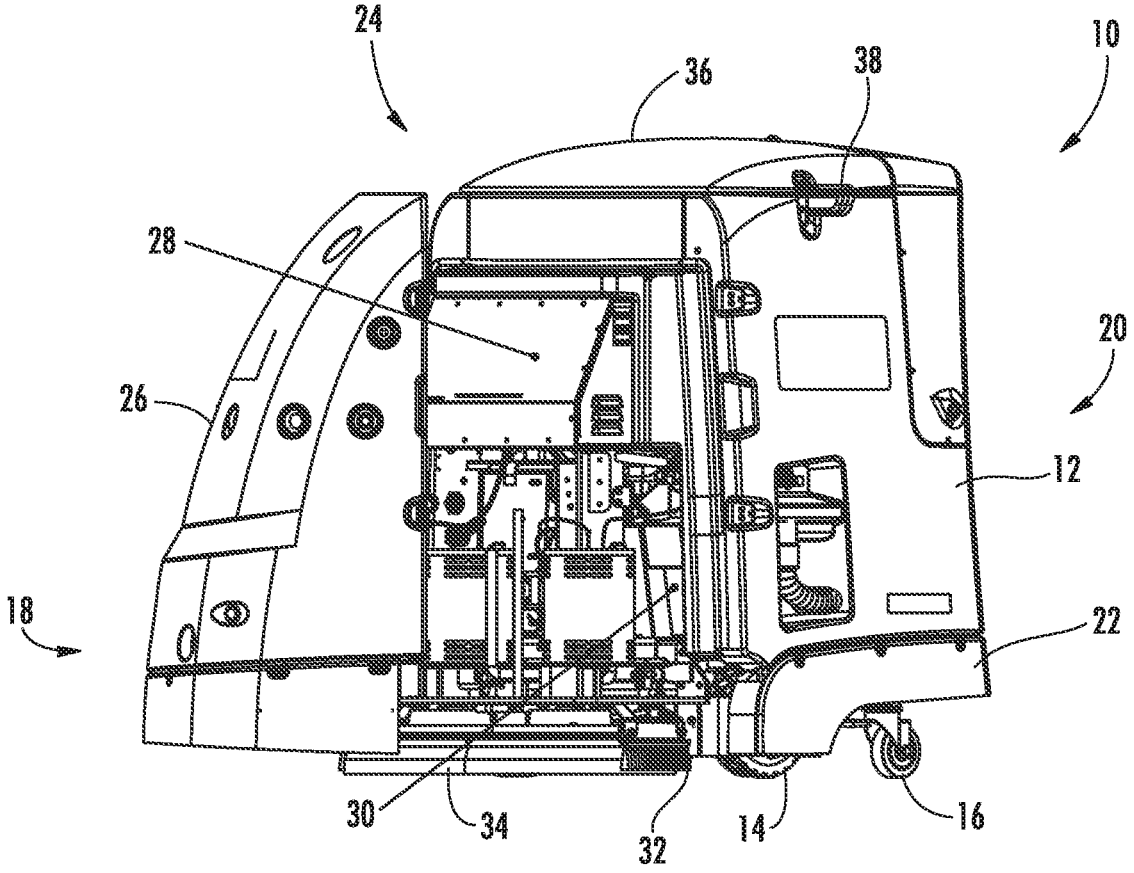
FIG. 1 is a perspective view of an exemplary cleaning device according to an embodiment.

Referring now to embodiments of the invention in more detail, FIG. 1 shows an exemplary cleaning device 10 that is mostly covered by a lightweight shell 12 and maneuvers on a set of wheels, including drive wheels 14 to propel the cleaning unit 10 and caster wheels 16, which permit turning about very small radii. The cleaning device 10 includes a front portion 18, a rear portion 20, a left side 22 and right side 24 (from the perspective of an operator walking behind a forward traveling cleaning device 10.

At the front portion 18, a front cover 26 can be opened to expose the inner components of the cleaning device 10. In FIG. 1, the front cover 26 is illustrated in an open position to view inner components, including electronics unit 28 and rolling chassis 30. Portions of the inner components are omitted or cutaway for clarity. For example, a portion of rotating brush 32 and squeegee 34 are visible at the bottom of cleaning unit 10. The illustrated example of cleaning unit 10 includes two rotating brushes 32 that are more clearly visible in the top-down view of FIG. 6. Used cleaning solution or spills standing on the floor may be vacuumed or otherwise suctioned into the cleaning device through the squeegee 34 as shown in FIGS. 1 and 4 or 112 as represented in FIG. 5. The fluid collected by the squeegee 34, 112 is recycled as shown and described in FIG. 5. In one embodiment, the cleaning unit 10 uses a fluid recycling system as described in U.S. Pat. No. 9,028,617.

The illustrated cleaning unit 10 also includes a top cover 36 that can be opened via latch 38 to expose a solution tank 40 (see FIGS. 5 & 6) to store cleaning solution. Cleaning solution may be a liquid used to clean floor surfaces, such as water, a chemical solution, a combination of water and one or more chemical solutions and/or the like. The solution tank 40 is located towards the top of the exemplary cleaning unit 10 for ease of use and to permit easy access for operators to fill and clean the solution tank 40. An unfortunate consequence of this location for the cleaning tank 40 is that leaks at any given location within the cleaning unit 10 may have a tendency to drip down into electronics and or power supply components. Similar results may occur if the cleaning unit is exposed to water from precipitation or incorrect cleaning procedures. Accordingly, modifications to the cleaning unit 10 may eliminate much of the risk of danger caused by unwanted water intrusion into sensitive electrical components.

Figure 2:
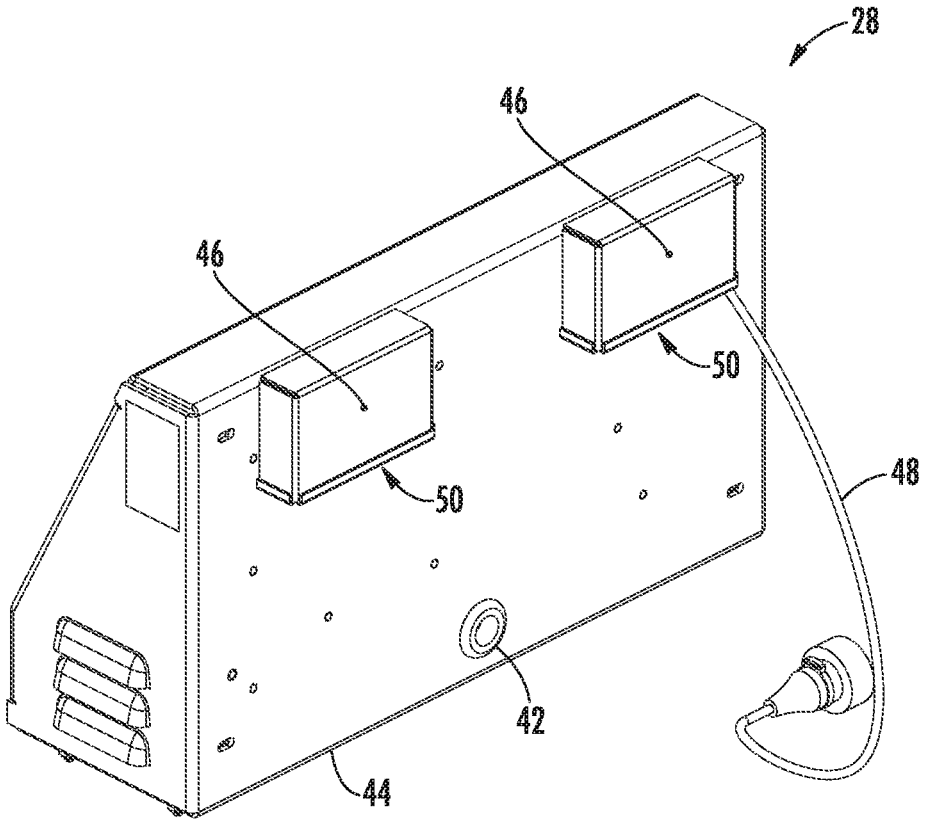
FIG. 2 is a perspective view of an exemplary electronics unit housed within a cleaning device according to an embodiment.

Referring now to FIG. 2, the electronics unit 28 is viewed from the rear of the unit where various electrical, sensor, and communications wiring enters into and exits from the unit through a plurality of wire openings 42. A number of important components are housed within the electronics unit 28 such as a main controller, IO board, gyroscopes, and drive amplifiers (not shown). Therefore, it is desirable to keep these sensitive electrical components dry. Wire openings 42 are large enough to accommodate a number cables and harnesses (mostly omitted from FIG. 2, except e.g., wire 48) passing through the wire openings 42. Unfortunately, this also means that the wire openings 42 are also large enough to permit significant volumes of liquid to enter the electronics unit 28. At a minimum, the wire openings 42 in the electronics unit 28 are preferably raised above the bottom 44 of the electronics unit so that liquids pooling in areas outside of the electronics unit 28, but near the bottom 44 do not easily pass into the interior of the electronics unit 28. If the potential for water to pool near the wire openings 42 exists, it may be desirable to add drain holes or other features (not shown) to guide this water away from the electronics unit 28.

Furthermore, the embodiment illustrated in FIG. 2 shows protective covers 46 to protect wires 48 and interior electronics from abnormal failure caused by water intrusion. The protective covers 46 at the top of the electronics unit 28 cover one or more other wire openings 42 (not seen). Also, in practice, the wire opening 42 shown in FIG. 2 at the bottom of the electronics unit 28 may also be covered by a third protective cover 46. In the embodiment shown, the protective covers are closed at the top and sides. Wires 48 are able to pass into the interior of the electronics unit 28 by first passing through a bottom opening 50 of the protective cover 46. Since the protective covers 46 are closed on the top and sides, the covers 46 are able to deflect water away from wire openings 42 where wires 48 pass into electrical dry areas, such as within electronics unit 28. Thus, liquids that might drip down from above or that might spray horizontally (e.g., from a leaking coupling or hose), are blocked by covers 46 and not allowed to pass into the electrical dry areas. In the illustrated embodiment, the protective covers 46 are substantially rectangular, but other shapes, including for example circular, elliptical, trapezoidal, or conical shapes are also feasible.

Figure 3:
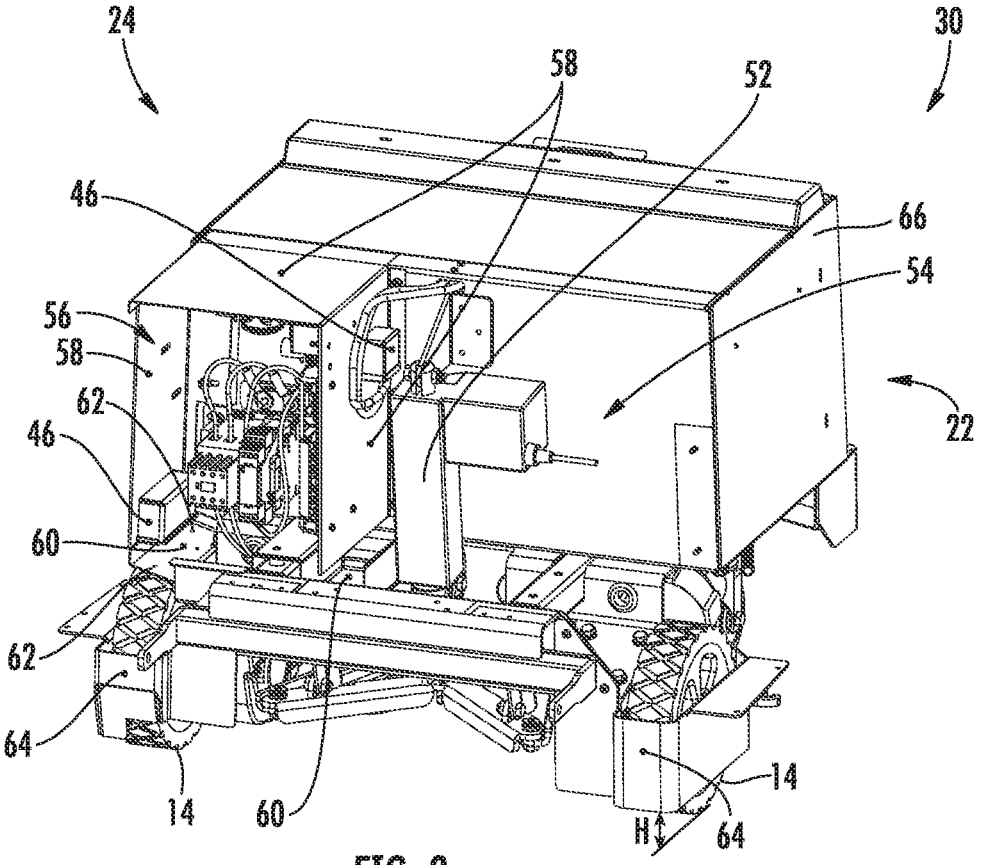
FIG. 3 is a perspective view of an exemplary rolling chassis housed within a cleaning device according to an embodiment.

FIG. 3 depicts the rolling chassis 30 of an example cleaning unit 10. The rolling chassis 30 includes a variety of mechanical components such as actuators, motors, valves (not specifically shown), drive wheels 14 and actuator 52 for altering or adjusting the position or operation of one or more cleaning components (e.g., vacuums, squeegee 34, 112 and/or brushes 32). In embodiments, the mechanical components may be situated in a "wet" portion 54 of the chassis 30, which is distinguished from a "dry" compartment 56 of the chassis 30 in which sensitive electrical components are located. The electrical components located within the dry compartment 56 may include, for example, solenoids, fuses or circuit breakers, and bus bars (not specifically identified) or other higher voltage (e.g., 24V) components. Certain components, such as solenoids, may be placed in either the wet 54 or the dry 56 compartments depending on their environmental or ingress protection grades. Thus, electronic components constructed with proper sealing characteristics may operate properly even in the wet areas 54 of the chassis. Notably, the dry compartment 56 in the illustrated example is located towards the right side 24 of the cleaning unit while the wet portion 54 is located towards the left side 22 of the cleaning unit 10. The dry compartment 56 may be protected by splash shields 58 defining top and bottom sides of the dry compartment 56. The splash shields 58 may include one or more protective covers 46 to prevent liquids from flowing into the dry compartment 56 through wire openings 42 located on the splash shields 58.

In addition to the splash shields 58 located on the top and sides of the dry compartment 56, one or more drip shields 60 define a bottom side of the dry compartment 56. Drip shields 60 differ slightly from splash shields 58 in that the drip shields 60 include one or more drain holes 62 to allow any liquid that enters the dry compartment 56 to drain downwards to the floor and towards brushes 32 and squeegee 34, 112. The size of the drain holes 62 is selectively chosen to permit cleaning liquid but not other materials to flow through. For instance, in the event of a fire within the dry compartment, certain plastic materials may melt and the drain holes 62 are preferably small enough to prevent molten plastic from escaping the dry compartment, thus containing the fire. Depending on the types of materials that may melt in such an instance, the drain holes 62 may be selected to be between about 1.5 mm and 2.0 mm. In one embodiment, the drain holes 62 are 1.9 mm in diameter.

As an added protective measure, FIG. 3 also shows protective covers 64 substantially covering drive wheels 14 above a height H from the bottom of the wheels 14. The wheel covers preferably prevent damage to nearby obstacles or persons that might occur if the cleaning unit drives over an obstacle or, for example, the foot of a person. The height H may be set to be less than 35 mm, and preferably within a range between 34.5 mm to 34.9 mm. In one embodiment, the wheel covers 64 provide protection in both the forward and rearward directions. With the height of the cover 64 set appropriately, the cover will push an object or a foot, for example, out of the way to prevent the wheel from riding up and over a foreign object or feet. The shape of the wheel covers may be modified as needed to accommodate other moving parts of the cleaning unit 10 while still adequately protecting surrounding objects.

Figure 8:
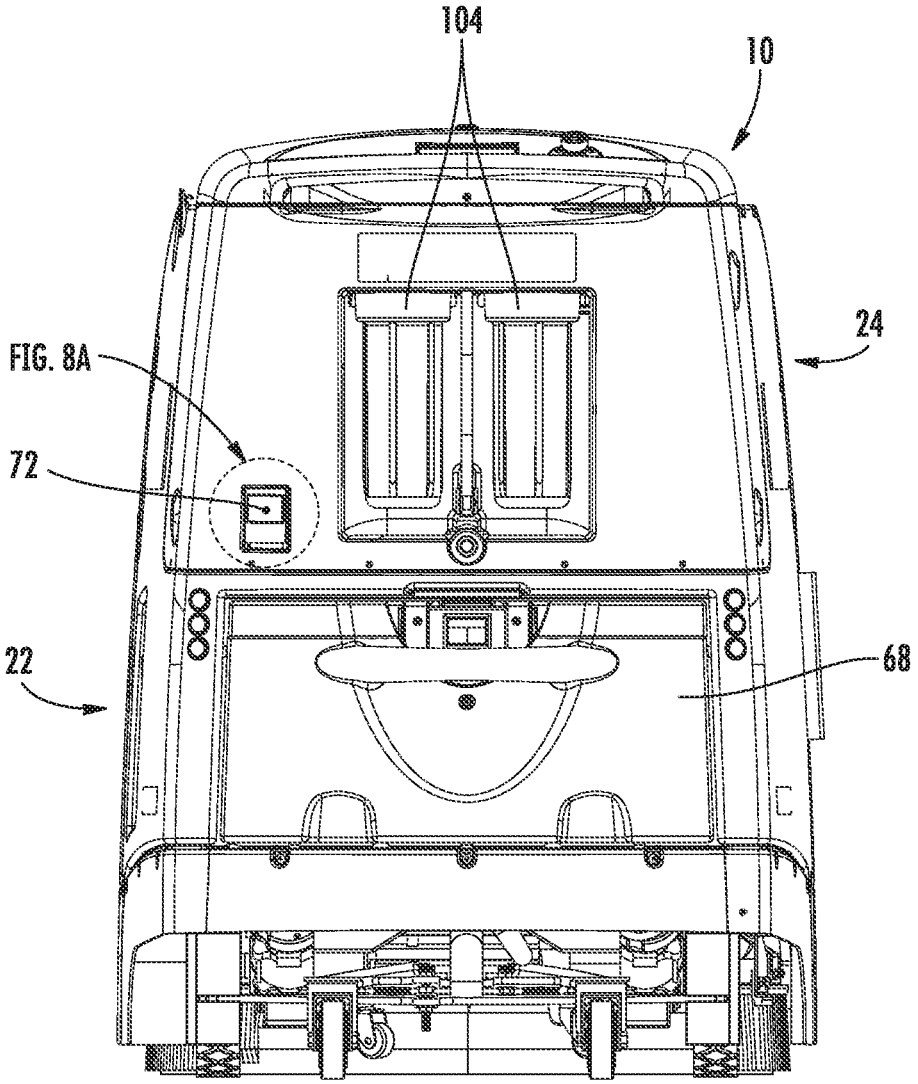
FIG. 8 is a rear view of an exemplary cleaning device according to an embodiment.
Figure 8A:
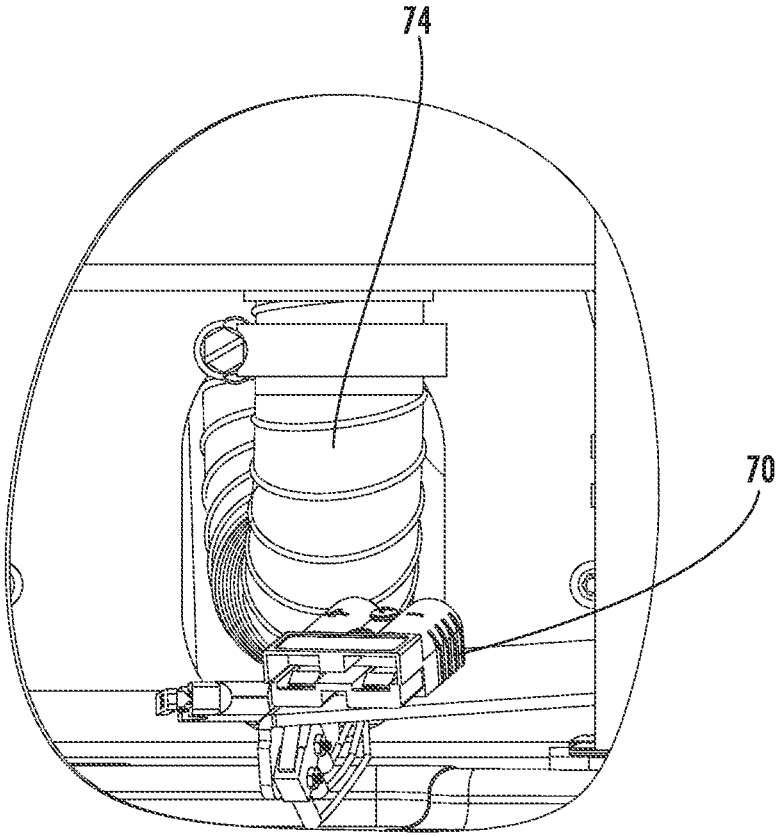
FIG. 8A is a detail cutaway view of the exemplary cleaning device of FIG. 8 according to an embodiment.

FIG. 3 also shows an enclosed battery compartment 66 that covers a battery unit (not shown). The battery compartment 66 is closed on all sides, top and bottom and is accessible by battery door 68 at the rear of the cleaning unit as shown in FIG. 8 to remove and replace the battery unit (not shown). In one embodiment, the battery door 68 is opened to remove and replace the battery. In one embodiment, the battery door 68 forms an integrated rear wall of the battery compartment 66. In one or more embodiments, the battery compartment 66 may include small vent holes to allow for hydrogen gas escape, even though sealed batteries may be used. During an abnormally excessive charge (e.g., above 30 Amps) hydrogen can vent from batteries. The charging system may be limited to a more desirable limit, such as 20 A or 25 A, through the use of inline fuses, voltage limiters, or a fused connection 70 (FIG. 8A) that is accessible behind a covered charging access door 72 at the rear of the cleaning unit 10. It is worth noting that the fused charging connection 70 and associated connectors, wiring and fuses is also located in a dry compartment in proximity to a vacuum pump and hose 74 in contrast to any wet areas that might include, for example liquid supply lines or liquid pumps (see e.g., the wet components in FIG. 5). In the illustrated embodiment, the dry compartment is located at the rear 20 of the cleaning unit 10.

Figure 4A:
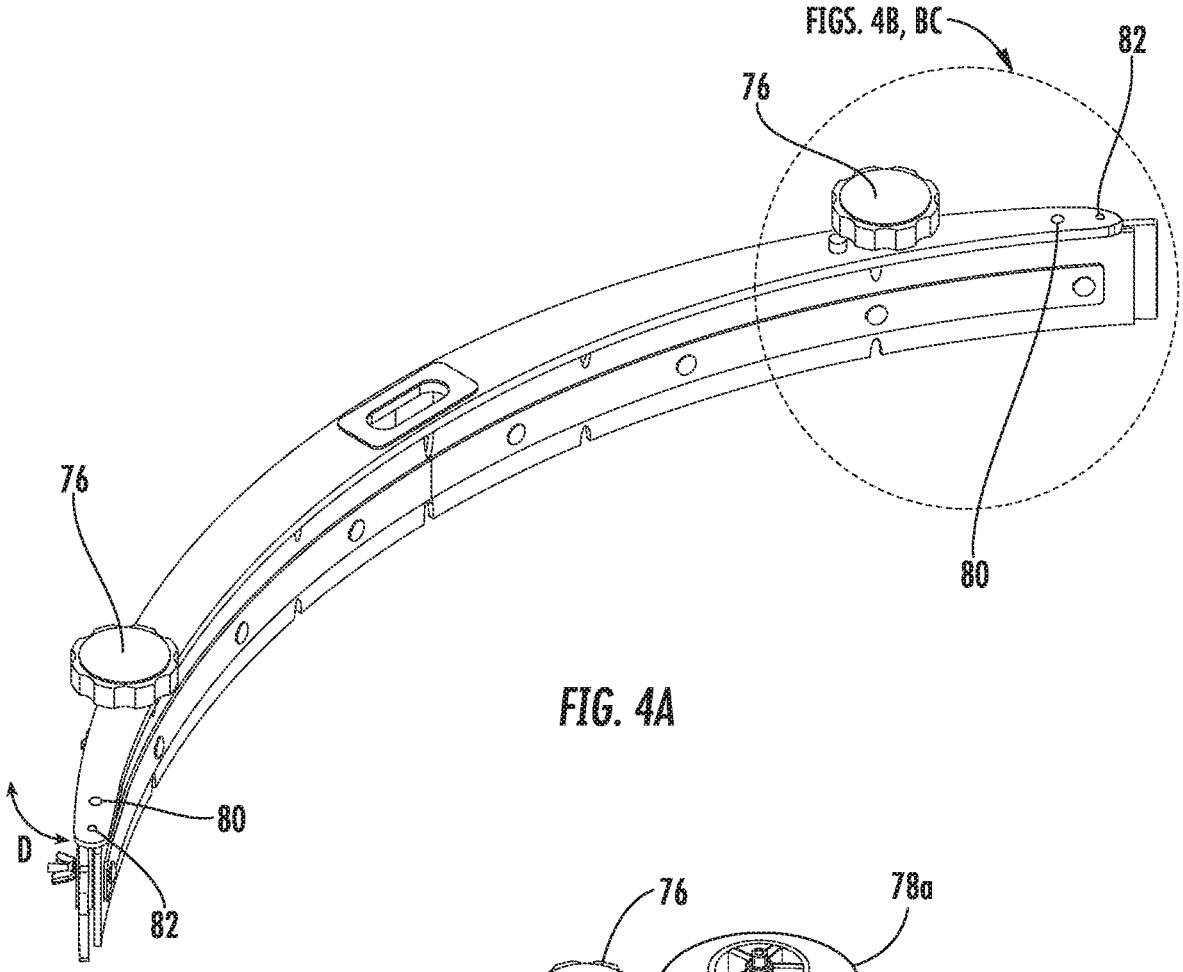
FIG. 4A is a perspective view of an exemplary squeegee unit housed within the cleaning device of FIG. 1 according to an embodiment.
Figure 4B:
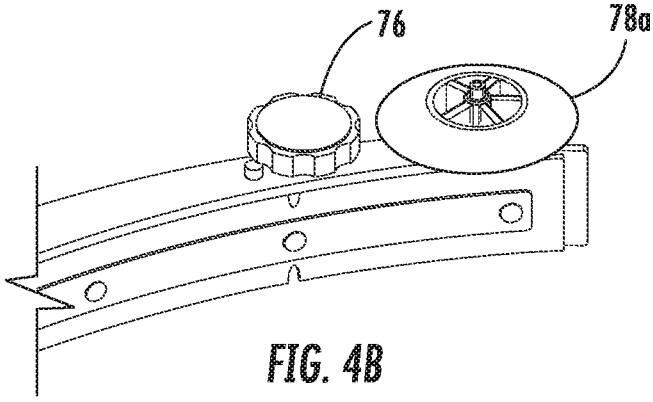
FIG. 4B is a detail view of the exemplary squeegee unit of FIG. 4A according to an embodiment.
Figure 4C:
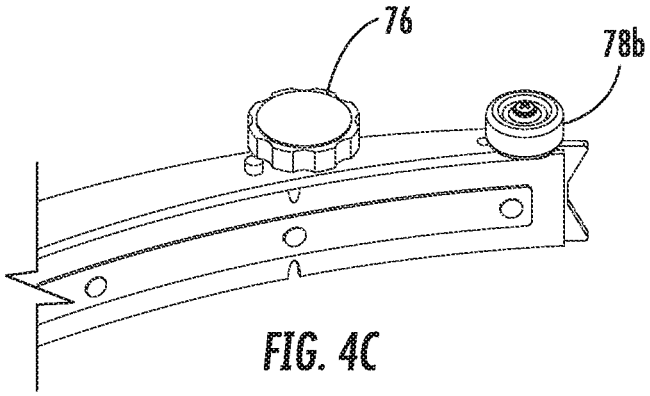
FIG. 4C is a detail view of the exemplary squeegee unit of FIG. 4A according to an embodiment.
Figure 5:
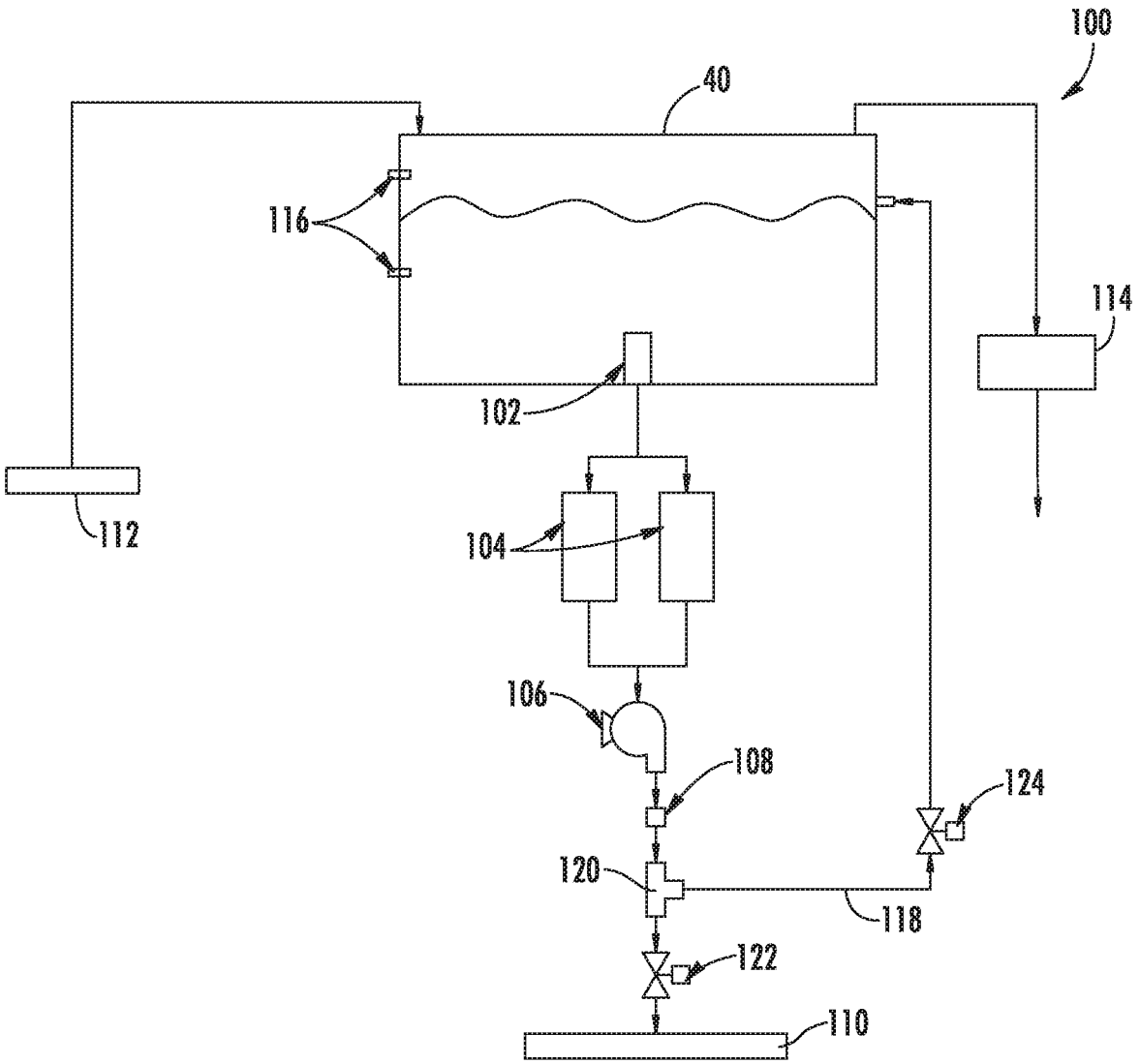
FIG. 5 is a diagram of an exemplary fluid recycling system utilized within a cleaning device according to an embodiment.

FIGS. 4A-4C show a physical representation of embodiments of a squeegee 34 configured for use in cleaning unit 10. The squeegee 34 may be mounted to the cleaning unit 10 by threaded retainers secured by rotating knobs 76. The squeegee 34 is mounted to the cleaning unit 10 in a movable configuration. A deflection wheel 78*a*, 78*b* is situated at each lateral end of the squeegee 34. The deflection wheel 78*a*, 78*b* serves to minimize damage to the cleaning unit 10 and/or any obstacles since the deflection wheels 78*a*, 78*b* will roll along the surface of an obstacle while the squeegee 34 deflects away (e.g, along directions D) from the obstacle or perhaps towards the underside of the cleaning unit 10 under the force of any impact. The deflection wheel 78*a*, 78*b* may be mounted to one of two different mounting holes 80 or 82 depending on the size of the deflection wheel. In one embodiment shown in FIG. 4C, a small deflection wheel 78*b* is mounted to an outermost mounting hole 82. In another embodiment shown in FIG. 4B, a large deflection wheel 78*a* is mounted to an innermost mounting hole 80. The distance between the mounting holes 80 and 82 may be similar to or proportional to the difference in radius between the different size deflection wheels 78*a* and 78*b* so that the squeegee 34, as a whole, does not extend outwards by a greater amount in either of the two configurations. The larger diameter deflection wheel 78*a*, in conjunction with the position of the inner mounting hole 80, might produce a greater amount of deflection of the squeegee 34 if the squeegee mounting configuration permits. In one embodiment, a central axis of the deflection wheel 78*a* or 78*b* mounted on squeegee 34 is aligned to the sides 22, 24 of the cleaning unit 10.

FIG. 5 shows a fluid recycling system 100 used in the exemplary cleaning unit 10 and may include one or more of a solution tank 40, a tank filter 102, first and second discharge line filters 104, a pump 106, a flow meter 108, a cleaning head 110, a squeegee 34, 112 and a vacuum motor 114. In an embodiment, a cleaning head 110 may include one or more scrubbers, brushes, nozzles, vacuums and/or the like. In an embodiment, a solution tank 40 may be a single tank, and it may store cleaning solution. Cleaning solution may be a liquid used to clean one or more surfaces, such as water, a chemical solution, a combination of water and one or more chemical solutions and/or the like. A solution tank 40 may have one or more inlets through which cleaning solution enters the solution tank. In an embodiment, a solution tank 40 may have one or more outlets through which cleaning solution exits the solution tank. In an embodiment, a solution tank 40 may include one or more float switches 116 to detect a level of cleaning solution present in the solution tank 40. For example, the float switches 116 may be positioned to indicate a high level or a low level of cleaning solution in the solution tank 40. In an embodiment, a tank filter 102 may be located within a solution tank 40 in proximity to and/or in fluid communication with an outlet of the solution tank. In an embodiment the tank filter 102 may be a sump filter formed from 100 mesh (or another size) stainless steel wire. The tank filter 102 may filter solution as it is drawn from within the solution tank 40 to an outlet of the solution tank. For example, the tank filter 102 may filter dirt or other debris from the solution as it exits the solution tank 40.

The discharge line filters 104 may each be any suitable filter, such as a cartridge filter. In an embodiment, the discharge line filters 104 may be located outside of the solution tank 40 (visible in FIG. 8) so that they filter fluid that has been discharged from an outlet of the solution tank. In an embodiment, a solution tank 40 may be in fluid communication with the discharge line filter 104. For example, a solution tank 40 may be connected to the discharge line filters 104 by one or more fluid lines, fittings, and/or a tee fitting. In an embodiment, the discharge line filters 104 may be fluidly connected in parallel as illustrated by FIG. 5 or alternatively in series. In an embodiment, the discharge line filters 104 may be a pleated filter, a wound cotton filter and/or the like and may be formed from pleated cellulose, polyester and/or polypropylene and may have one or more plastic ends and a core.

In an embodiment, the first and/or the second discharge line filter 104 may filter dirt or other debris from received cleaning solution that is discharged from the solution tank 40. In an embodiment, typically when the first and the second discharge line filters 104 are connected in parallel, the first discharge line filter and the second discharge line filter may each be of substantially the same filter size. Alternatively, such as when the discharge line filters 104 are connected in series, the filters may have different filter sizes. In an embodiment, a filter size of a filter may refer to the size of the largest particles that can be filtered by the filter. For example, a filter having a filter size of 1 micron can filter particles having a size of 1 micron or larger. In an embodiment, a first discharge line filter 104 in a series configuration may be a 10 micron filter so that it filters large particles in the cleaning solution. The second discharge line filter 104 may be a 1 micron filter so that it filters fine particles that remain in the cleaning solution. In an embodiment, the first and the second discharge line filters 104 may have equal filter sizes. For example, the first discharge line filter and the second discharge line filter may both be 10 micron filters. Additional and/or alternate sized filters may be used within the scope of this disclosure.

In an embodiment, the recycling system 100 may include a bypass line 118. The bypass line 118 may fluidly connect an inlet of the solution tank 40 and the downstream end of the flow meter 108. In an embodiment, a tee fitting 120 may be located downstream from the flow meter 108 and upstream from a valve 122, which may control flow of cleaning solution to the cleaning head 110. In an embodiment, valve 122 may be a solenoid valve or other type of valve. In an embodiment, a bypass line 118 may connect the tee fitting 120 and the solution tank 40 to divert cleaning fluid toward the solution tank 40 and away from the cleaning head 110. In an embodiment, a bypass line 118 may connect the tee fitting 120 and the solution tank 40 via a second valve 124. The second valve 124 may be associated with the cleaning head 110. In an embodiment, the second valve 124 may be located upstream from the cleaning head 110, but downstream from the flow meter 108. In an embodiment, the second valve 124 may be a solenoid valve or other type of valve.

Figure 6:
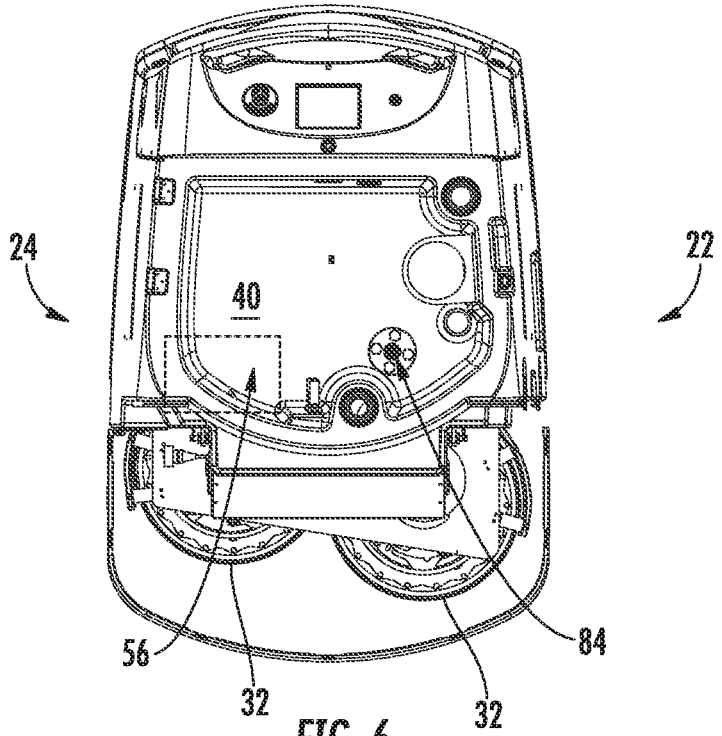
FIG. 6 is a top-down view of an exemplary cleaning device according to an embodiment.
Figure 7:
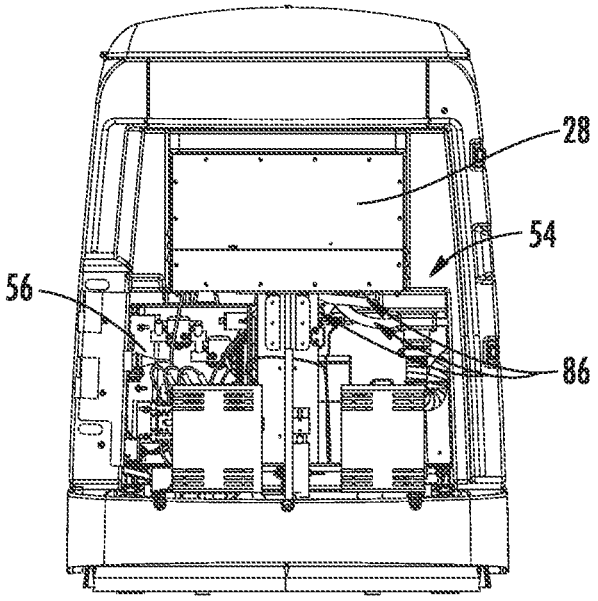
FIG. 7 is a front view of an exemplary cleaning device according to an embodiment.

FIG. 6 shows a top view of an exemplary cleaning unit 10 where the solution tank 40 is visible. Also visible in FIG. 6 is liquid exit port 84, which is positioned towards a left side 22 of the cleaning unit 10 thereby keeping the exit port 84, which is a potential source of liquid leaks, away from the dry compartment 56, which is designated by a dashed box in FIG. 6 and which is located towards a right side 24 of the cleaning unit. The exemplary cleaning unit 10 also includes other measures to make sure that liquid flow lines, fittings, and connections are kept away from dry compartment 56. For example, FIG. 7 shows fluid lines 86 passing from the solution tank 40 down towards the cleaning head 110 passing in the wet area 54 outside of the dry compartment 56. Generally, liquid flow lines 86 and drip channels can be configured to divert liquid to the side or in front of the dry compartment 56 for collection by squeegee 34, 112 and vacuum.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A cleaning device for cleaning floors comprising:

a solution tank configured to store cleaning solution, wherein the solution tank is located at a top side of the cleaning device and comprises an outlet;

a motorized chassis located beneath the solution tank and comprising an electronics compartment, the electronics compartment defined at least partly by splash shields and a drip shield, the splash shields defining a top and sides of the electronics compartment, and the drip shield defining a bottom side of the electronics compartment;

at least one wire opening in one of the splash shields;

a protective cover overlying the at least one wire opening, the protective cover containing at least one passage facing in a direction opposite to the solution tank and adapted to allow a wire to pass through the passage and through the wire opening into the electronics compartment; and fluid lines extending from the outlet towards a bottom of the cleaning device and exterior to the electronics compartment.

2. The cleaning device of claim 1, wherein the electronics compartment is situated laterally to a first side of the cleaning device and the fluid lines extend downward laterally to a second side laterally opposite the first side.

3. The cleaning device of claim 2, wherein the outlet and the fluid lines are disposed entirely at the second side of the cleaning device.

4. The cleaning device of claim 1, wherein the at least one passage of the protective cover faces downward.

5. The cleaning device of claim 1, wherein the drip shield comprises at least one drip hole.

6. The cleaning device of claim 5, wherein the drip hole is smaller than 2 mm in diameter.

7. The cleaning device of claim 1, wherein the motorized chassis comprises at least one of a motor for vacuuming the floor or a cleaning component for cleaning the floor.

8. An autonomous floor cleaning machine comprising:

an enclosed electronics unit comprising at least one of electrical, sensor, and communications components and associated wiring entering into and exiting from the electronics unit through at least one first wire opening;

a dry compartment comprising splash shields defining a top and sides of the dry compartment, the dry compartment further comprising at least one additional electrical component and associated wiring entering into and exiting from the dry compartment through at least one second wire opening in one of the splash shields;

a cleaning solution tank located at a top side of the cleaning machine and at least partially disposed above the electronics unit and the dry compartment;

a protective cover overlying the at least one first and second wire openings, the protective cover containing at least one passage facing downward in a direction opposite to the cleaning solution tank and sized to allow the associated wiring to pass through the passage and through the wire openings; and a wet compartment disposed outside of the dry compartment and comprising fluid lines extending from the cleaning solution tank towards a bottom of the floor cleaning machine.

9. The cleaning machine of claim 8 further comprising a motorized chassis comprising at least one of a motor for vacuuming the floor or a cleaning component for cleaning the floor.

10. The cleaning machine of claim 8, wherein the dry compartment and the wet compartment are laterally disposed with respect to each other.

11. The cleaning machine of claim 8, wherein the dry compartment further comprises a drip shield defining a bottom side of the dry compartment, the drip shield comprising at least one drip opening.

12. The cleaning machine of claim 11, wherein the at least one drip opening is smaller than 2 mm in width.

13. The cleaning machine of claim 8 further comprising a motorized chassis with a plurality of wheels for maneuvering across the floor, each wheel comprising a protective wheel cover that covers portions of the wheel that are at a height greater than or equal to 35 mm.

14. The cleaning machine of claim 8 further comprising a squeegee that is mounted to the cleaning machine in a movable configuration, the squeegee comprising inner and outer deflection wheel mounts, a small deflection wheel adapted for installation to the outer deflection wheel mount and a large deflection wheel adapted for installation to the inner deflection wheel mount, a distance between the inner and outer deflection wheel mounts being proportional to a difference in size between the small and large deflection wheels.

15. The cleaning machine of claim 8 wherein the first wire opening is spaced above a bottom of the enclosed electronics unit.

* * * * *